US005951250A

United States Patent [19]

Suenaga et al.

[11] Patent Number: 5,951,250

[45] Date of Patent: Sep. 14, 1999

[54] TURBINE COOLING APPARATUS

[75] Inventors: Kiyoshi Suenaga; Sunao Aoki; Yoshiaki Tsukuda; Youichi Iwasaki, all of Hyogo-ken, Japan

[73] Assignee: Mitsubishi Heavy Industries, Ltd., Tokyo, Japan

[21] Appl. No.: 09/035,616

[22] Filed: Mar. 5, 1998

[51] Int. Cl.[6] ..... B63H 1/14

[52] U.S. Cl. ..... 416/96 R; 416/95; 416/97 R; 415/115

[58] Field of Search ..... 416/95, 96 R, 416/96 A, 97 R, 97 A; 415/115

[56] References Cited

U.S. PATENT DOCUMENTS 3,602,605 8/1971 Lee et al. ..... 415/116
3,759,038 9/1973 Scalzo et al. ..... 60/39.32
5,639,216 7/1997 McLaurin et al. ..... 416/95

*Primary Examiner*—Edward K. Look
*Assistant Examiner*—Ninh Nguyen
*Attorney, Agent, or Firm*—John P. White; Cooper & Dunham LLP

[57] ABSTRACT

A turbine cooling apparatus comprising a turbine disk having a plurality of moving blades, a torque tube coupled coaxially to one surface side of the turbine disk and having a thick stepped inner wall portion in the central portion thereof, an air separator fitted on the torque tube with the inner surface thereof in contact with the outer surface of the torque tube so that a passage through which cooling air is supplied to the moving blades via the turbine disk is defined between the air separator and the torque tube, and a torque tube cooling hollow portion provided along and in the vicinity of the outer surface of the thick stepped wall portion of the torque tube.

6 Claims, 4 Drawing Sheets

TURBINE COOLING APPARATUS

BACKGROUND OF THE INVENTION

The present invention relates to a turbine cooling apparatus applicable to a torque tube section that is used to supply cooling air for moving blades of a high-temperature gas turbine from a stationary system to a rotating system (rotor) after the air is extracted from a compressor.

FIGS. 1 and 2 show a conventional gas turbine cooling apparatus. A cylindrical torque tube 2 is coupled coaxially to one side a turbine disk 6 that has a plurality of moving blades 7. The inner surface of the central portion of the disk 6 is thick and stepped. An air separator 1 is fitted on the tube 2 so that its inner surface is in contact with the outer surface of the tube 2. Formed between the separator 1 and the torque tube 2 is a passage a through which cooling air is supplied to the moving blades 7. An intermediate shaft cover 5, having a cavity 5*a* therein, is put on the outer surface of the separator 1. The cover 5 is connected to a cooling air supply pipe 4. In FIG. 1, numeral 10 denotes a spindle bolt.

In this arrangement, the moving blade cooling air is fed from the cooling air supply pipe 4 to a rotating-side passage a via the cavity 5*a*. Then, the cooling air is delivered to the moving blades 7 through holes in the disk 6.

As shown in FIG. 1, the air separator 1 has a very thin wall, while the torque tube 2 has a thick-walled portion. Accordingly, there is a substantial difference in thermal capacity between these two members.

During actual-load operation with the operation pattern shown in FIG. 3, the ambient temperature around the air separator 1 is stable, so that the respective temperatures of the separator and the torque tube are constant, as shown in FIG. 4. When the ambient temperature changes, especially when the turbine is stopped, cold air passes through the air separator. Owing to the aforesaid difference in thermal capacity, therefore, the transient metal temperature change varies. Accordingly, the air separator and the torque tube are differently deformed by heat, that is, there is a substantial difference in deformation between them. Possibly, this difference may exert a bad influence on the gas turbine.

BRIEF SUMMARY OF THE INVENTION

The object of the present invention is to provide a turbine cooling apparatus, in which deformation in a gas turbine can be restrained without any temperature difference between an air separator and a torque tube as the temperature changes unsteadily when operation is stopped, for example, so that the life performance and reliability of the gas turbine can be improved.

In order to achieve the above object, according to the present invention, there is provided a turbine cooling apparatus comprising a turbine disk having a plurality of moving blades, a torque tube coupled coaxially to one surface side of the turbine disk and having a thick stepped inner wall portion in the central portion thereof, and an air separator fitted on the torque tube with the inner surface thereof in contact with the outer surface of the torque tube so that a passage through which cooling air is supplied to the moving blades via the turbine disk is defined between the air separator and the torque tube. In this apparatus, one or a plurality of torque tube cooling hollows are provided along and in the vicinity of the outer surface of the thick stepped wall portion of the torque tube.

Due to the presence of the torque tube cooling hollows, the thermal capacity of the outer surface portion of the torque tube is small.

When the temperature changes unsteadily, therefore, the temperature difference between the air separator and the torque tube is reduced, so that there is no possibility of a difference in thermal deformation exerting a bad influence.

According to the invention, moreover, there is provided a turbine cooling apparatus comprising a turbine disk having a plurality of moving blades, a torque tube coupled coaxially to one surface side of the turbine disk and having a thick stepped inner wall portion in the central portion thereof, and an air separator fitted on the torque tube with the inner surface thereof in contact with the outer surface of the torque tube so that a passage through which cooling air is supplied to the moving blades via the turbine disk is defined between the air separator and the torque tube. In this apparatus, one or a plurality of torque tube cooling holes are provided along and in the vicinity of the outer surface of the thick stepped wall portion of the torque tube. The cooling holes communicate with that portion of the passage which is remoter from the turbine disk.

In this arrangement, some cooling air is run through the passage and the torque tube cooling holes, and cools the outer surface portion of the torque tube as it is discharged. Thus, the tube is compulsorily air-cooled to a temperature near that of the air separator. When the temperature changes unsteadily, therefore, the temperature difference between the air separator and the torque tube is reduced, so that there is no possibility of a difference in thermal deformation exerting a bad influence.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Figure 1:
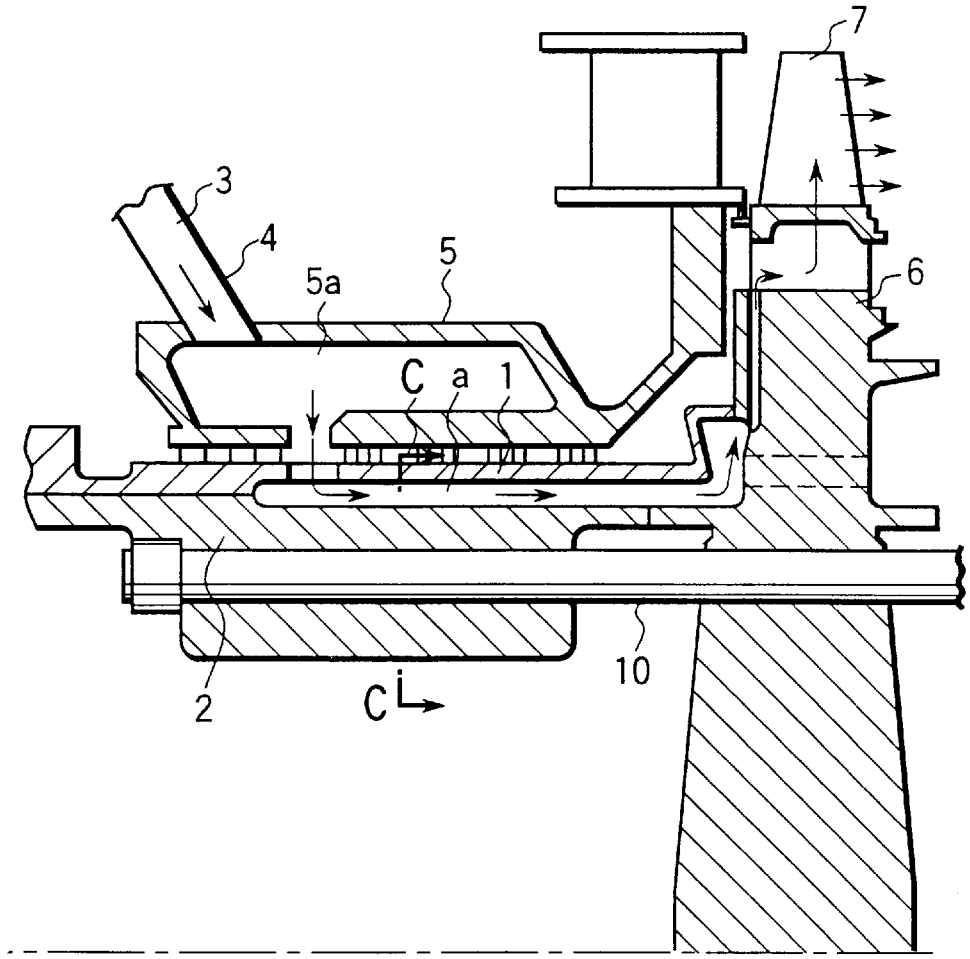
FIG. 1 PRIOR ART
FIG. 1 is a sectional view of a prior art example.
Figure 2:
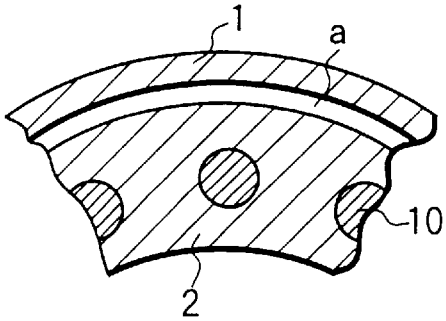
FIG. 2 PRIOR ART
FIG. 2 is a sectional view of the prior art example taken along line C—C of FIG. 1.
Figure 3:
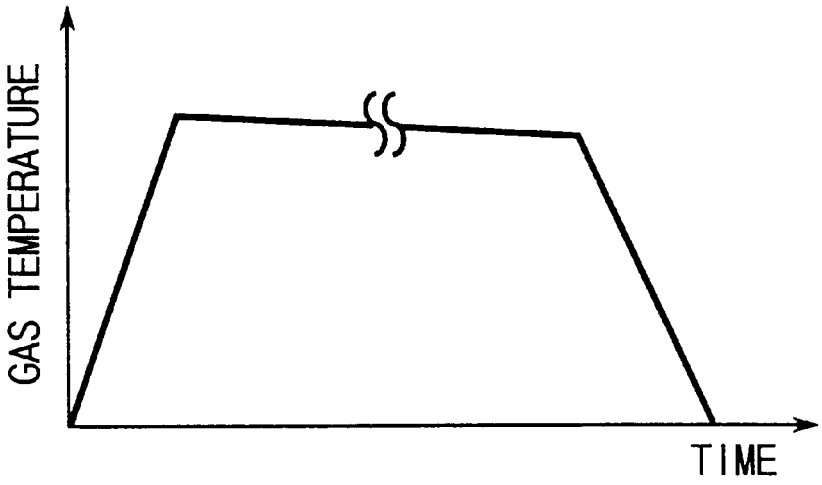
FIG. 3 PRIOR ART
FIGS. 3 and 4 are diagrams for illustrating the prior art example.
Figure 4:
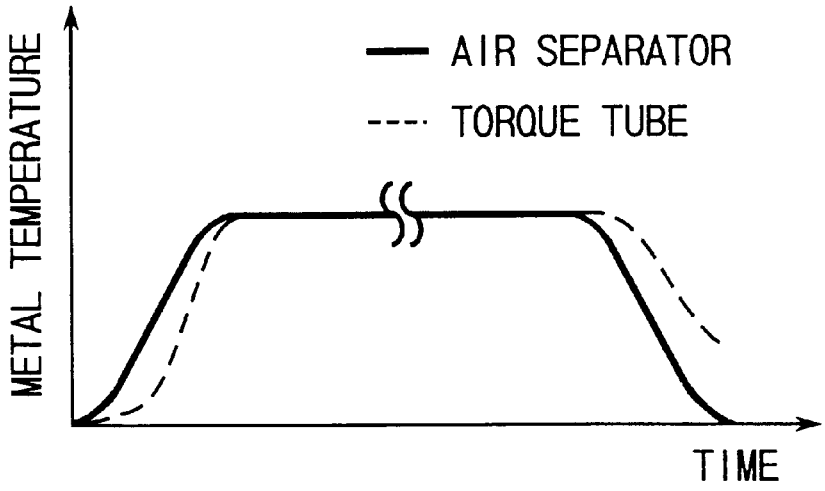
FIG. 4 PRIOR ART
Figure 5:
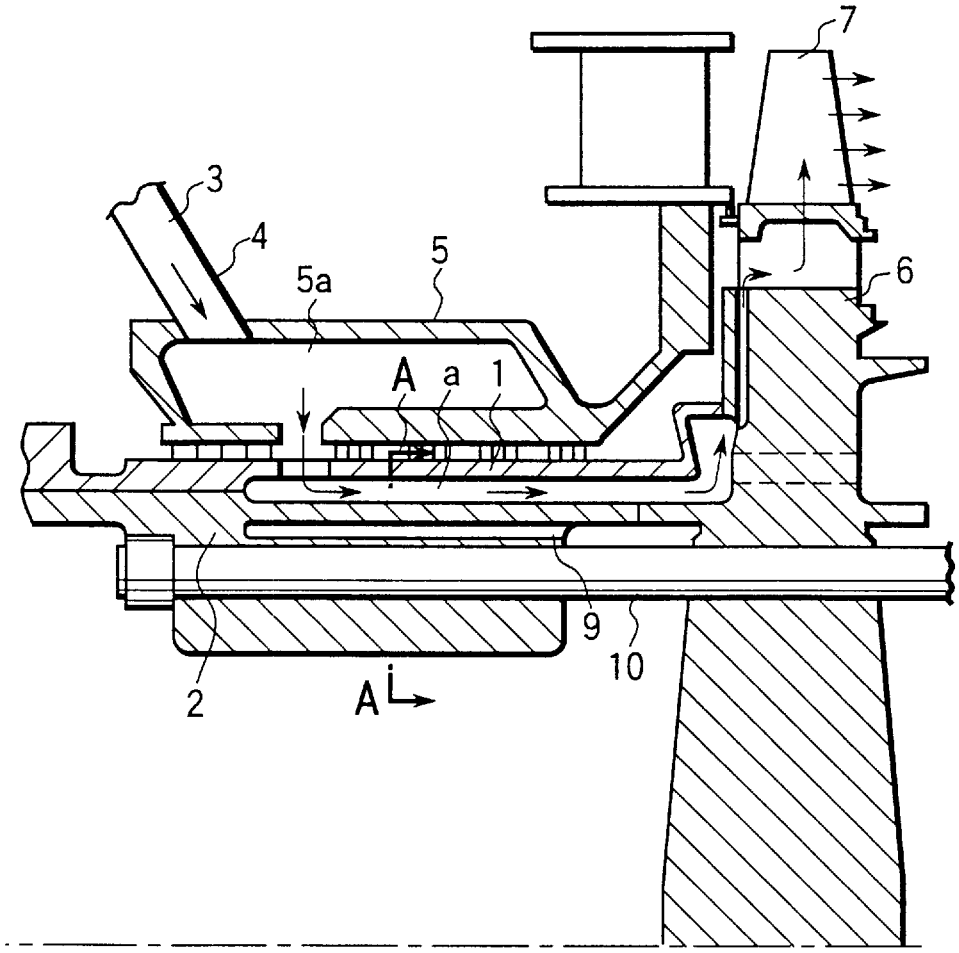
FIG. 5 is a sectional view of a first embodiment of the present invention.
Figure 6:
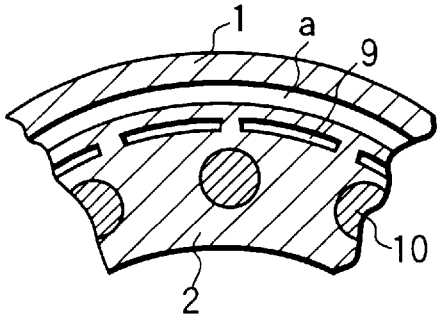
FIG. 6 is a sectional view of the first embodiment taken along line A—A of FIG. 5.

Referring to FIGS. 5 and 6, a first embodiment of the present invention will be described. In the description to follow, like reference numerals are used to designate like portions throughout the drawings for simplicity of illustration. Torque tube cooling hollows 9 are formed in a thick stepped wall portion of a torque tube 2. The hollows 9, extending parallel to the axis of the tube 2 and having a flat cross section, are arranged at regular pitches in the circumferential direction in the vicinity of the outer surface of the stepped wall portion.

Due to the presence of the torque tube cooling hollows 9, the thermal capacity of the outer surface portion of the torque tube 2 is small.

When the temperature changes unsteadily, therefore, the temperature difference between an air separator 1 and the torque tube 2 is reduced, so that there is no possibility of a difference in thermal deformation exerting a bad influence.

Figure 7:
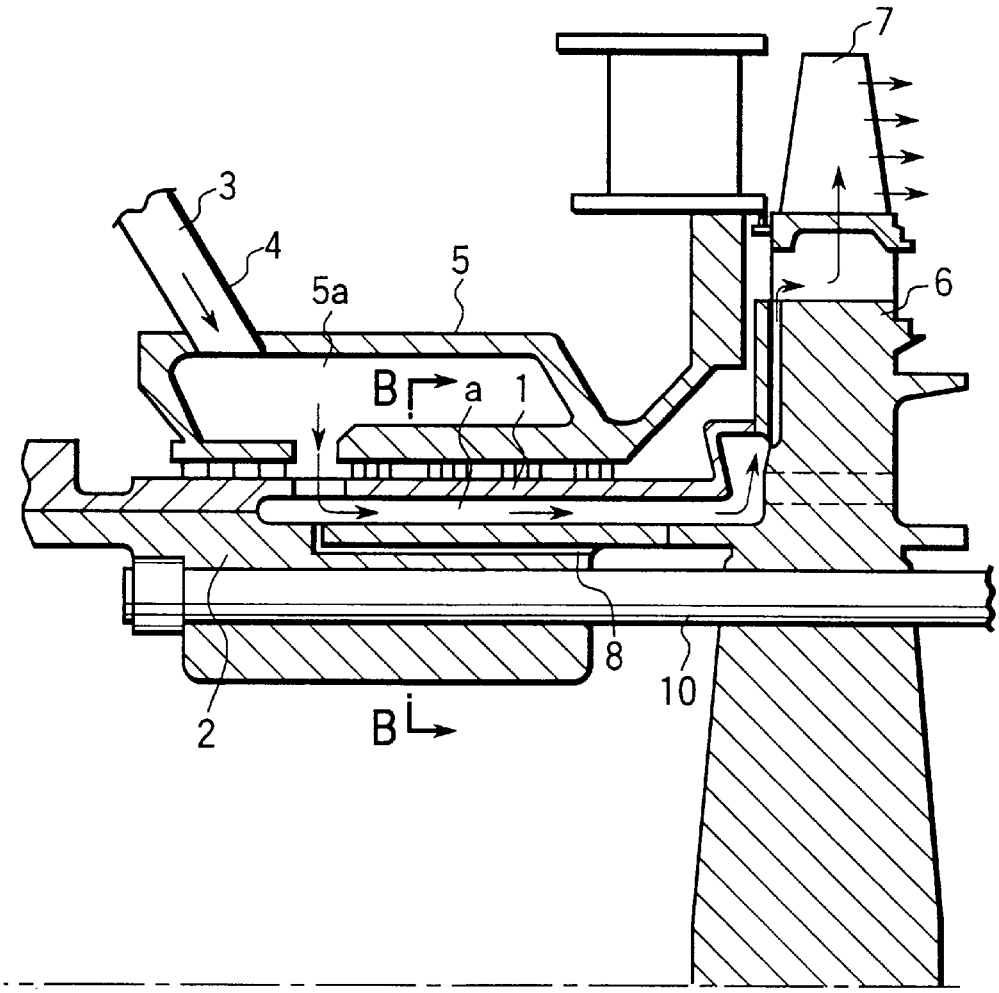
FIG. 7 is a sectional view of a second embodiment of the invention.
Figure 8:
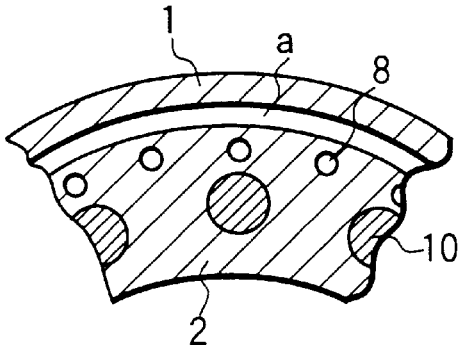
FIG. 8 is a sectional view of the second embodiment taken along line B—B of FIG. 7.

Referring to FIGS. 7 and 8, a second embodiment of the invention will be described. Torque tube cooling holes 8 are formed in a thick stepped wall portion of a torque tube 2. The holes 8 extend parallel to the axis of the tube 2 and arranged at regular pitches in the circumferential direction in the vicinity of the outer surface of the stepped wall portion. The proximal end of each cooling hole 8 communicates with to that portion of a passage a which is remoter from a disk 6.

In this arrangement, some of cooling air is run through the passage a and the torque tube cooling holes 8, and cools the outer surface portion of the torque tube 2 as it is discharged. Thus, the tube 2 is compulsorily air-cooled to a temperature near that of an air separator 1. When the temperature changes unsteadily, therefore, the temperature difference between the air separator 1 and the torque tube 2 is reduced, so that there is no possibility of a difference in thermal deformation exerting a bad influence.

According to the present invention, as described above, deformation in the gas turbine can be restrained without any temperature difference between the air separator and the torque tube as the temperature changes unsteadily when operation is stopped, for example, so that the life performance and reliability of the gas turbine can be improved considerably.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

We claim:

1. A turbine cooling apparatus comprising:

a turbine disk having a plurality of moving blades;

a torque tube coupled coaxially to one surface side of the turbine disk and having a thick stepped inner wall portion in the central portion thereof;

an air separator fitted on the torque tube with the inner surface thereof in contact with the outer surface of the torque tube so that a passage through which cooling air is supplied to the moving blades via the turbine disk is defined between the air separator and the torque tube; and a torque tube cooling hollow portion provided along and in the vicinity of the outer surface of the thick stepped wall portion of the torque tube.

2. A turbine cooling apparatus according to claim 1, wherein said torque tube cooling hollow portion includes one or a plurality of torque tube cooling hollows.

3. A turbine cooling apparatus according to claim 1, wherein said torque tube cooling hollow portion is provided on the turbine disk side.

4. A turbine cooling apparatus comprising:

a turbine disk having a plurality of moving blades;

a torque tube coupled coaxially to one surface side of the turbine disk and having a thick stepped inner wall portion in the central portion thereof;

an air separator fitted on the torque tube with the inner surface thereof in contact with the outer surface of the torque tube so that a passage through which cooling air is supplied to the moving blades via the turbine disk is defined between the air separator and the torque tube; and a torque tube cooling hole portion provided along and in the vicinity of the outer surface of the thick stepped wall portion of the torque tube.

5. A turbine cooling apparatus according to claim 4, wherein said torque tube cooling hole portion includes one or a plurality of torque tube cooling holes.

6. A turbine cooling apparatus according to claim 4, wherein said torque tube cooling hole portion communicates with that portion of the passage which is remoter from the turbine disk.

* * * * *